US010669135B2

(12) United States Patent
Haase

(10) Patent No.: US 10,669,135 B2
(45) Date of Patent: Jun. 2, 2020

(54) ROTARY CRANE AND METHOD FOR ROTARY CRANE

(71) Applicant: GBF Gesellschaft Fuer Bemessungsforschung MBH, Aachen (DE)

(72) Inventor: Ralf Haase, Aachen (DE)

(73) Assignee: GBF Gesellschaft Fuer Bemessungsforschung MBH, Aachen (DE)

( * ) Notice: Subject to any disclaimer, the term of this patent is extended or adjusted under 35 U.S.C. 154(b) by 0 days.

(21) Appl. No.: 15/708,420

(22) Filed: Sep. 19, 2017

(65) Prior Publication Data

US 2018/0065835 A1 Mar. 8, 2018

Related U.S. Application Data

(63) Continuation of application No. PCT/EP2016/056010, filed on Mar. 18, 2016.

(30) Foreign Application Priority Data

Mar. 19, 2015 (DE) ..... 10 2015 104 148

(51) Int. Cl.

| | |
|---|---|
| ***B66C 23/88*** | (2006.01) |
| ***B66C 23/84*** | (2006.01) |
| ***B66C 23/94*** | (2006.01) |
| ***B66C 13/18*** | (2006.01) |
| ***B66C 23/02*** | (2006.01) |

(52) U.S. Cl.

CPC ..... *B66C 23/88* (2013.01); *B66C 13/18* (2013.01); *B66C 23/022* (2013.01); *B66C 23/84* (2013.01); *B66C 23/94* (2013.01)

(58) Field of Classification Search

CPC ..... B66C 23/84; B66C 23/88; B66C 23/94

See application file for complete search history.

(56) References Cited

U.S. PATENT DOCUMENTS

| | | | | |
|---|---|---|---|---|
| 5,894,291 | A * | 4/1999 | Lee | H01Q 1/005 343/874 |
| 2008/0111379 | A1* | 5/2008 | Altemark | F03D 7/0204 290/44 |
| 2009/0263246 | A1* | 10/2009 | Bolz | F03D 7/042 416/61 |
| 2016/0362283 | A1* | 12/2016 | Munst | B66C 23/84 |
| 2018/0044149 | A1* | 2/2018 | Weckbecker | B66C 13/18 |

FOREIGN PATENT DOCUMENTS

| | | | | |
|---|---|---|---|---|
| CA | 2790152 | A1 * | 8/2011 | B66C 23/84 |
| DE | 102010008713 | A1 | 8/2011 | |
| JP | 2010083659 | A | 4/2010 | |

* cited by examiner

*Primary Examiner* — Donald J Wallace

(74) *Attorney, Agent, or Firm* — Von Rohrscheidt Patents

(57) ABSTRACT

A rotary crane including a vertical axis; an jib that extends from the vertical axis; a drive for rotating the jib about the vertical axis; a condition monitoring which determines wind loading, namely internal force variables, tensions, strains, transverse forces, tilting and torsion torques of the rotary crane; and a computing unit which computes a preferred direction for locking the jib from the wind loading. The invention also relates to a method for orienting the rotary crane. In order to improve the orientation of the jib of a shut down rotary crane it is proposed that the rotary crane includes measuring elements for capturing local measuring local values of the wind loading.

8 Claims, 2 Drawing Sheets

ROTARY CRANE AND METHOD FOR ROTARY CRANE

RELATED APPLICATIONS

This application is a continuation of International application PCT/EP2016/056010 filed on Mar. 18, 2016 claiming priority from German Patent Application DE 10 2015 104 148.0 filed on Mar. 19, 2015, both of which are incorporated in their entirety by this reference.

FIELD OF THE INVENTION

The invention relates to a rotary crane.

The wind loading and thus the stability of a rotary crane substantially depends on flow conditions at the jib, thus its orientation relative to the wind. For designing a rotary crane for operations the wind loading according to EN 1990 and the utilization is computed as a ratio of wind loading and component resistance irrespective of the orientation of the jib relative to the wind. Above a maximum wind velocity $v_{smax}$ at which the computed utilization exceeds a permissible value at any orientation operations of the rotary crane are stopped.

Rotary cranes and methods of the type recited supra are known from DE 10 2010 008 713 A1 and JP 2010-83659 A. A wind direction and a wind velocity are measured and an orientation of the rotary crane is optimized there from using a model. An accident prone rotation of the jib about the vertical axis, the so called auto rotation, in particular when the flow has some interference for example on large construction sites shall be prevented according to EP 2 025 637 A1 in that the stewing ring is not released completely but a defined breaking torque reduces the rotation speed of the jib.

BRIEF SUMMARY OF THE INVENTION

Thus, it is an object of the invention to improve an orientation of a jib on a shut-down rotary crane.

The object is achieved by a rotary crane including a vertical axis; a jib that extends from the vertical axis; a drive for rotating the jib about the vertical axis; a condition monitoring which determines wind loading represented by local measuring values of internal force variables, tensions, strains, transverse forces, tilting and torsion torques of the rotary crane; a computing unit which computes a preferred direction for locking the jib from the wind loading; and measuring elements configured to capture the local measuring values of the wind loading.

Improving upon the known rotary crane it is proposed according to the invention to provide measuring elements for capturing local measurement valves representing wind loading. The invention is based on the finding that the phenomenon of auto rotation for an interfered incident flow of the rotary crane is based on a direction of minimum wind loading which deviates from the wind direction and which cannot be determined solely from the wind direction and the wind velocity even with complex models, wherein this deviation can seriously impair the stability of the shutdown rotary crane even when auto rotation is prevented. Only computing a preferred direction with minimum wind loading from locally measured values of the wind loading facilitates locking the jib in this direction of minimum wind loading.

Advantageously a rotary crane according to the invention includes a signal unit which transmits a signal for locking the jib in the preferred direction to the drive. The connection of computing unit and drive by the signal unit facilitates in a rotary crane according to the invention to automatically orient the jib. Alternatively the jib that is adjusted for zero wind impact can be locked in the preferred direction when it is oriented in this direction by chance. Alternatively the jib can be rotated into the preferred directions manually using the drive.

Advantageously the rotary crane according to the invention includes a locking brake for locking the jib in the preferred direction. Locking brakes at stewing rings are known in the art and can be used for locking the crane in the preferred direction in a particularly simple manner. Alternatively the drive can be controlled in a rotary crane according to the invention so that the jib remains in the preferred direction.

Improving upon the known method it is proposed according to the invention that local measurement values for wind loading are measured at the rotary crane. The methods according to the invention are performed in particular with one of the rotary cranes according to the invention described supra and are characterized by the advantages described supra.

In an advantageous embodiment of the method according to the invention a wind direction is monitored and considered when computing the preferred direction. An individual wind direction that is measured at a position at the rotary crane or in its direct proximity typically already represents a good approximation of the direction with minimum wind loading. The approximation becomes the better the more measurements of the wind direction and velocity are provided at different positions and which are computed into the monitored wind direction with their respective portion or the wind loading.

Advantageously the wind loading is stored as a function of the incident flow direction of the jib according to the method according to the invention and as a function of the wind direction a direction of the jib is selected as a preferred direction where the wind loading is at a minimum. Storing in various directions of the jib facilitates determining the incident flow direction and thus the direction of the jib where the wind loading is minimal by using a comparison. The measurement values can be initially stored in predetermined degree increments (for example 10°) according to an approximation and can be successively verified and refined by measurement values and optionally through support by an expert system.

Advantageously a direction of rotation of the jib is selected in a method according to the invention so that a maximum wind loading is minimized when the jib is rotated in the preferred direction. Storing data in all directions of the jib facilitates determining a direction of rotation where the maximum wind loading is minimal by doing a comparison.

Advantageously a utilization of the rotary crane is monitored by a method according to the invention and considered when computing the preferred direction. In this method according to the invention the design of the rotary crane can be verified in a particularly simple manner.

The rotary crane according to the invention can be configured in particular as a top rotating or bottom rotating turret rotary crane with a trolley jib or with an elevation angle adjustable jib and on a fixed foundation or on rails.

BRIEF DESCRIPTION OF THE DRAWINGS

The invention is subsequently described based on embodiments with reference to drawing figures, wherein.

Figure 1:
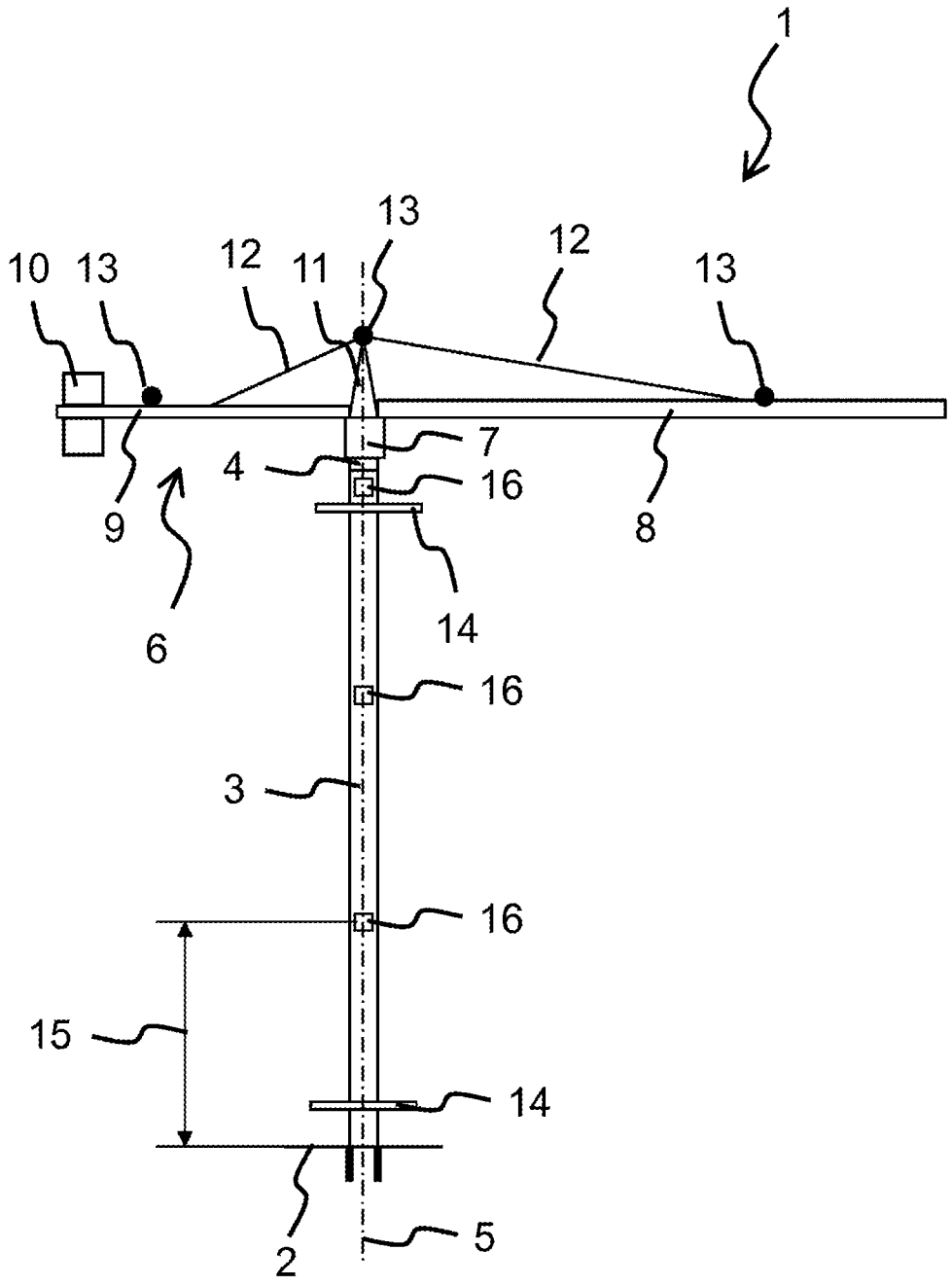
FIG. 1 illustrates a schematic view of a first rotary crane according to the invention.

The rotary crane 1 according to the invention that is illustrated in FIG. 1 is a top rotating turret rotary crane and includes a concrete foundation 2, a turret 3 that is based therein torque proof and an upper crane 6 that is rotatably supported by a stewing ring 4 on the turret 3 about a vertical axis 5.

The upper crane 6 includes a cab 7 for an operator of the rotary crane 1 and above the cab 7 a jib 8, herein a trolley jib for carrying a non-illustrated load and a counter jib 9 with ballast 10. The jib 8 and the counter jib 9 are supported at a turret tip 11 arranged in the vertical axis 5 using tension links 12.

On the jib 8, the counter jib 9 and on the turret tip 11, three combined wind measuring devices 13 are arranged respectively for measuring a local wind speed (anemometer) and a wind direction (anemoscope) and three measuring elements 14, namely strain gauges are arranged at a top of the turret 3 and at the bottom of the turret 3 and at three locations at an even distance 15 from the foundation 2 to the cab 7 measuring elements 16 namely accelerometers are arranged.

Down below on the foundation 2 there is a non-illustrated control arrangement for the rotary crane 1 with condition monitoring. The condition monitoring monitors the measuring values of the measuring elements 14 and 16 and derives there from internal force variables, tensions and strains and transverse forces, tilting and torsion torques which are combined to loading (in the sense of EN 1990) of the rotary crane 1.

Furthermore the condition monitoring determines the portion of the wind loading from the loading of the crane in that the condition monitoring subtracts the influence of the load suspended at the jib 8 that is known from the jib position, hook load and trolley or elevation position of the jib and continuously stores the wind loading as a function of a wind direction that is computed as an arithmetic mean from the measured wind directions.

Figure 2A:
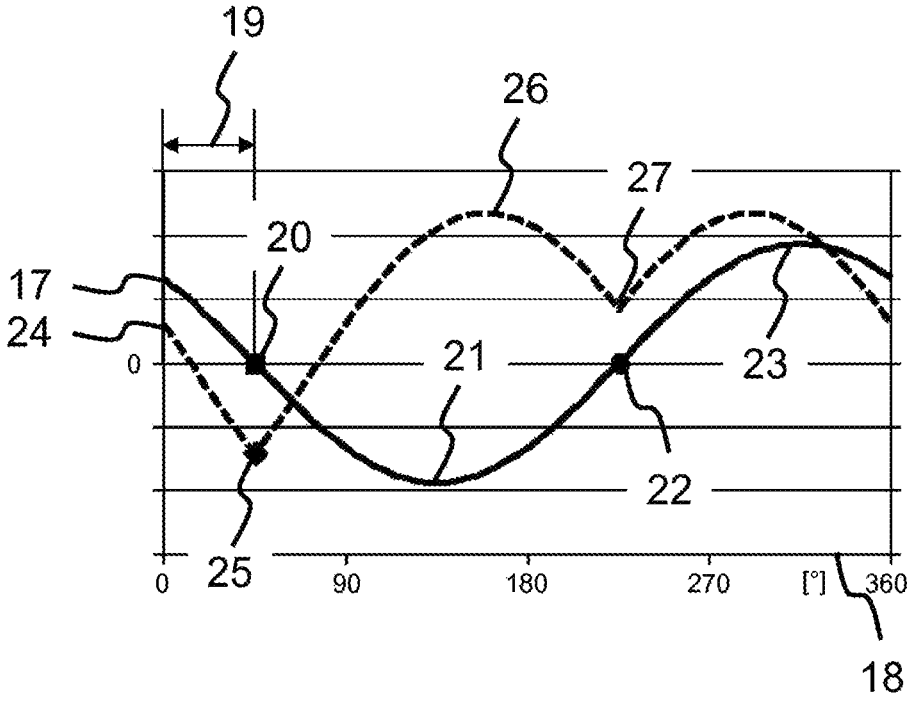
FIG. 2A illustrates the utilization of the rotary crane for a non-interfered incident flow.

The rotary crane 1 is configured to be set up in a non-illustrated construction site presuming a free incident flowing in the local meteorological main wind direction. FIG. 2A illustrates a sine shaped profile of the torque 17 impacting the upper crane 6 about the vertical axis 5 plotted over a relative angle 18 of the jib 8 versus a non-illustrated longitudinal axis of the foundation 2. The angular offset 19 of the torque 17 corresponds to an orientation of the longitudinal axis of the foundation 2 of approximately 45° counter clockwise relative to the main wind direction that is inherent to the construction site.

In the first zero crossing 20 of the torque 17 the jib 8 is pointing with the wind. The rotary crane 1 is without torque in this position, thus in equilibrium with respect to the wind loading. The equilibrium is stable because for each rotation of the upper crane 6 from this position the wind forces generate a torque 17 that counteracts the rotation.

For a further rotation of the upper crane 6 counter clockwise and an increase of the angle of attack by up to 90°, the wind generates an increasing torque 17 with negative prefix, thus against the direction of rotation wherein the absolute value of the torque reaches a maximum of 21 when the jib 8 is oriented transversal to the wind. During a counter clock wise rotation the torque 17 decreases towards the second zero crossing 22 where the jib 8 points into the wind. Also in this position the rotary crane 1 is in a torque equilibrium, however the equilibrium is instable because the wind forces generate a torque 17 that supports the rotation for each rotation from this position.

A further counter clock wise rotation yields an increasing torque 17 again with a positive prefix, thus supporting the rotation up to the second maximum 23 when the jib 8 is transversal to the wind again.

FIG. 2A furthermore illustrates a qualitative diagram of the utilization 24 of the rotary crane 1 with respect to a tilting torque at the crane base that is generated by the wind loading. The utilization 24 increases from an absolute minimum 25 in the first zero crossing 20 of the torque 17, thus when the jib is oriented with the wind, when rotated beyond a position transversal to the wind the torque increases to a maximum 26 and decreases to a local minimum 27 until the jib 8 is oriented into the wind. When the jib 8 is rotated further counter clockwise the utilization 24 is a mirror image down to the absolute minimum 25.

Figure 2B:
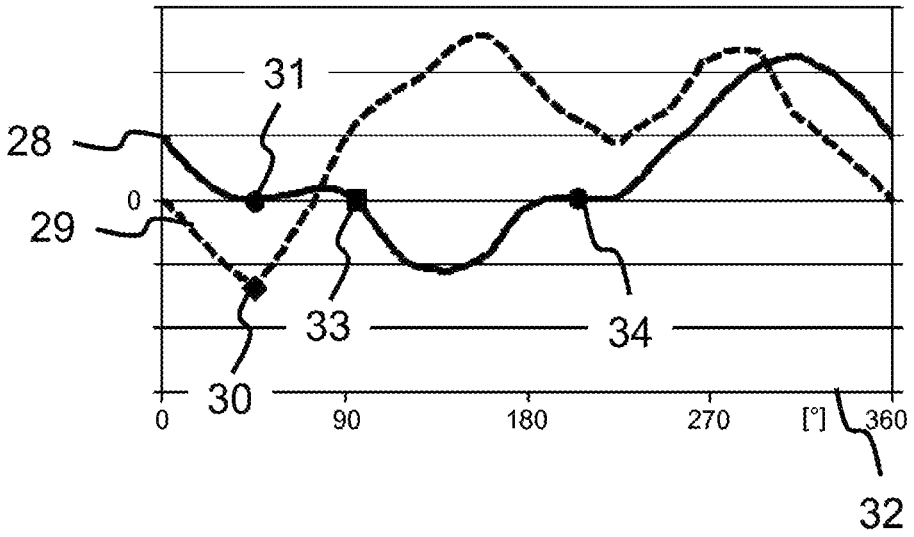
FIG. 2B illustrates the actual utilization at a construction site.

FIG. 2B illustrates diagrams for the torque 28 and the utilization 29 for the same wind direction determined from measurements at the construction site by the condition monitoring, wherein torque and utilization are significantly distorted by a building with rectangular plan form that is arranged in the main wind direction laterally in front of the rotary crane 1. At the absolute minimum 30 of the utilization 29 a zero crossing 31 of the torque 28, thus an equilibrium is provided, but this equilibrium is stable.

For a small random displacement of the upper crane 6 in counter clock wise direction, thus with increasing angle of attack 32 this rotation is supported by a small positive torque 28 up to a first zero crossing 33 of the torque 28. In this position the rotary crane 1 is in a stable equilibrium, however it is loaded by more than twice the amount compared to the minimum 30.

For a small random displacement of the upper crane 6 in clock wise direction, thus with a decreasing angle of attack 32, this rotation is not only supported slightly, but significantly accelerated by a quickly increasing torque 28. When the wind load is maintained, then the upper crane 6 due to the acceleration will not only pass through a position with maximum utilization 29 without braking but also through the unstable equilibrium position in the second zero crossing 34 of the torque 28 when the jib 8 is oriented into the wind. Since the torque 28 braking the rotation with a negative prefix has a significantly smaller absolute value in the adjoining portion there is an increased risk that also the stable equilibrium is transitioned and the upper crane 6 moves into auto rotation.

Accordingly diagrams of torques 28 and utilization 29 for all wind directions that can occur at the construction site are stored in the condition monitoring. When the rotary crane 1 according to the invention is shut down due to exceeding a maximum wind velocity $v_{smax}$ and a preset threshold value of the utilization 29 is exceeded, the condition monitoring determines from these diagrams angles of attack 32 of the upper crane 6 where the wind loading and thus the utilization 29 of the rotary crane 1 is at a minimum for the respective prevailing wind direction and the direction of rotation where the maximum wind loading is minimal when the upper crane 6 is rotated in this preferred direction and transmits both values to the control arrangement.

The control arrangement of the first rotary crane 1 according to the invention generates an acoustic alarm and signals to the operator a direction of rotation and a preferred direction of the jib 8. The operator steers into this direction using the drive at the slewing ring 4 and locks the jib 8 in this direction using the parking brake of the slewing ring.

In another embodiment of the rotary crane 1 that is otherwise identical the control device monitors the wind induced rotation of the upper crane that is turned with the wind brakes the upper crane automatically using the motor drive at the slewing ring when the preferred direction is being approached and in turn activates the locking brake.

In another rotary crane according to the invention that is otherwise identical the control device actively steers into the preferred direction through the drive at the slewing ring.

In another otherwise identical rotary crane according to the invention the condition monitoring captures meteorological wind data, wind velocity and direction, through remote data transmission and initiates a steering into a preferred direction also independently from exceeding a threshold value of the utilization in a precautionary manner wherein the wind loading is minimal in the preferred direction.

In another otherwise identical rotary crane according to the invention the condition monitoring is configured redundant.

REFERENCE NUMERALS AND DESIGNATIONS

| | |
|---|---|
| 1 | rotary crane |
| 2 | foundation |
| 3 | turret |
| 4 | slewing ring |
| 5 | vertical axis |
| 6 | upper crane |
| 7 | cab |
| 8 | jib |
| 9 | counterjib |
| 10 | ballast |
| 11 | turret tip |
| 12 | tension member |
| 13 | wind measuring device |
| 14 | measuring element (strain gauge) |
| 15 | distance |
| 16 | measuring element (acceleration sensor) |
| 17 | torque |
| 18 | angle of attack |
| 19 | angular offset |
| 20 | zero crossing |
| 21 | maximum |
| 22 | zero crossing |
| 23 | maximum |
| 24 | utilization |
| 25 | maximum |
| 26 | maximum |
| 27 | minimum |
| 28 | torque |
| 29 | utilization |
| 30 | minimum |
| 31 | zero crossing |
| 32 | angle of attack |
| 33 | zero crossing |
| 34 | zero crossing |

What is claimed is:

1. A rotary crane, comprising:

a vertical axis;

a jib that extends from the vertical axis;

a drive for rotating the jib about the vertical axis;

a condition monitor configured to determine wind loading from a wind, the wind loading represented by local measuring values of internal force variables, tensions, strains, transverse forces, tilting and torsion torques of the rotary crane;

a computing unit configured to compute a preferred direction for locking the jib from the local measuring values of internal force variables, tensions, strains, transverse forces, tilting and torsion torques of the rotary crane wherein the preferred direction minimizes the wind loading based on the local measuring values and coincides with a direction of the wind or deviates from the direction of the wind;

measuring elements configured to capture the local measuring values; and a locking brake capable of locking the jib in the preferred direction that deviates from the direction of the wind.

2. The rotary crane according to claim 1, further comprising a signal unit configured to transmit a signal for locking the jib in the preferred direction to the drive.

3. A method for orienting a rotary crane including a vertically extending vertical axis and a jib extending from the vertical axis and rotatable about the vertical axis, the method comprising the steps:

measuring at the rotary crane a wind loading represented by local measuring values of internal force variables, tensions, strains, transverse forces, tilting and torsion torques of the rotary crane;

computing a preferred direction for locking the jib from the local measuring values of internal force variables, tensions, strains, transverse forces, tilting and torsion torques of the rotary crane wherein the preferred direction minimizes the wind loading based on the local measuring values and coincides with a direction of the wind or deviates from the direction of the wind; and locking the jib in the preferred direction.

4. The method according to claim 3, wherein the jib is rotated into the preferred direction motor driven.

5. The method according to claims 3, wherein a wind direction is monitored and considered when computing the preferred direction.

6. The method according to claim 5, wherein the wind loading is stored as a function of an incident flow direction of the jib and a direction of the jib is selected as a function of the wind direction as the preferred direction where the wind loading is at a minimum.

7. The method according to claim 6, wherein a direction of rotation is selected so that a maximum wind loading is at a minimum when the jib is rotated into the preferred direction.

8. The method according to claim 3, wherein maximum threshold values of the local measuring values are monitored and considered when computing the preferred direction.

* * * * *